US005799944A

United States Patent [19]

Lemmon

[11] Patent Number: 5,799,944

[45] Date of Patent: Sep. 1, 1998

[54] GAME BOARD WITH NON-REMOVABLE PIECES

[76] Inventor: Sean Christian Lemmon, 116 N. Bend Ct., Waco, Tex. 76712

[21] Appl. No.: 861,193

[22] Filed: May 21, 1997

[51] Int. Cl.[6] ..... A63F 3/00

[52] U.S. Cl. ..... 273/281

[58] Field of Search ..... 273/236, 270, 273/271, 281, 282.1, 282.2, 282.3

[56] References Cited

U.S. PATENT DOCUMENTS

| | | | |
|---|---|---|---|
| 1,085,941 | 2/1914 | Russell | 273/281 |
| 3,689,072 | 9/1972 | Taylor | 273/281 |
| 4,434,982 | 3/1984 | Bearint | 273/281 X |
| 4,451,040 | 5/1984 | Ashley | 273/281 |
| 4,470,601 | 9/1984 | Finn | 273/281 X |
| 4,486,017 | 12/1984 | Evert, Jr. | 273/281 X |
| 4,793,278 | 12/1988 | Gillick | 273/281 |
| 4,886,278 | 12/1989 | Salter et al. | 273/281 X |
| 5,497,997 | 3/1996 | Nikas et al. | 273/281 X |

*Primary Examiner*—William E. Stoll
*Attorney, Agent, or Firm*—Patent & Trademark Services; Thomas Zack; Joseph H. McGlynn

[57] ABSTRACT

An assembly made of an indented tracked game board with a movable playing piece that cannot be removed from the track in the game board. Each playing piece has an enlarged head and base with a reduced diameter section in between, which section rides in the game board's track system. The width of the playing piece's head and base is sufficiently greater than the width of the track such that it cannot be removed therefrom. There are several playing stations for the different players each having their own tracks which are connected to the tracks of adjacent playing stations.

3 Claims, 4 Drawing Sheets

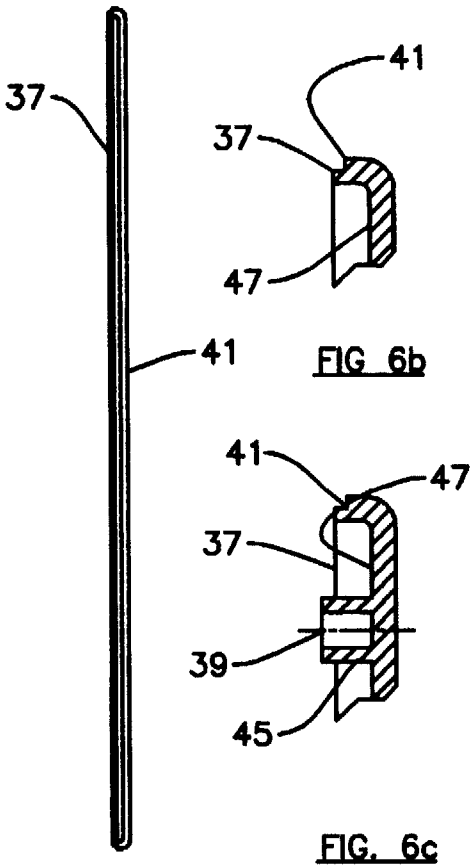
FIG. 6b
FIG. 6c
FIG. 6
FIG. 6a
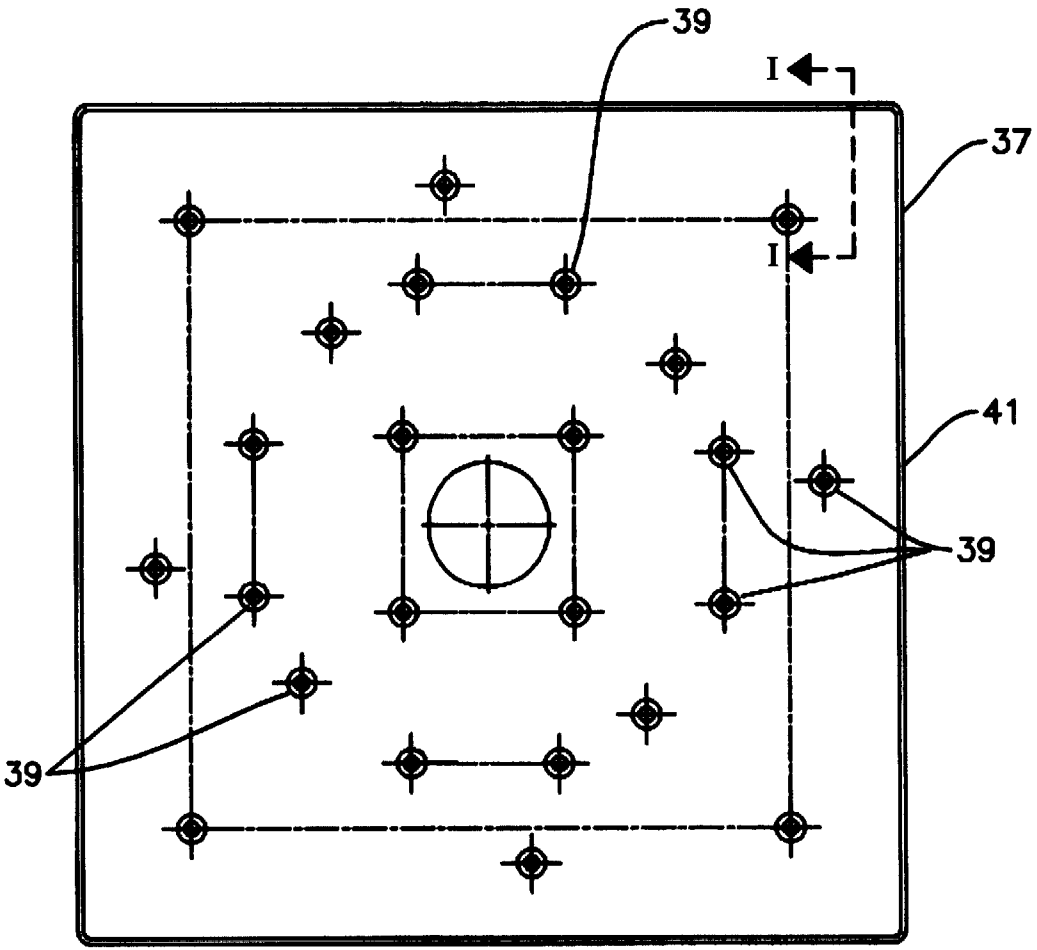
FIG. 5

GAME BOARD WITH NON-REMOVABLE PIECES

BACKGROUND OF THE INVENTION

Game boards having movable playing pieces of many types are known. In many such games, the playing piece is moved around the board to a designated location based upon numbers picked when an arrow is spun, a card selected or dice thrown. For many purposes such movable game pieces are satisfactory. However, when games are played in moving vehicles, planes and boats, or young children are present who may place them in their mouths or misplace the pieces, there is a need to confine the playing pieces to the game board.

Attempts have been made to confine the playing pieces using magnets on the piece's base that are attracted to the game board. This effort has provided a benefit, especially when many pieces are involved or the players are moving. However, the limited attraction provided by the magnets is no deterrent to even a small child who can still remove the playing pieces.

The present invention seeks to prevent the removal of the game board playing pieces from the board, thus insuring that children will not eat or otherwise dispose of them and providing a game board and playing piece combination wherein the playing pieces will not get lost or misplaced, as described herein.

DESCRIPTION OF THE PRIOR ART

Game boards having a great variety of movable playing pieces are well known. For example, in U.S. Pat. No. 5,011,156 to LaChance et al. playing pieces are moved around a game board wherein some numbers selections and the playing instructions are contained on a compact disc.

The Driscoll patent (U.S. Pat. No. 5,120,065) discloses a game board with a computer system that provides speech information to the players and cards which can be read.

In the Kim reference (U.S. Pat. No. 5,265,878) a color association game with discs is disclosed.

In U.S. Pat. No. 5,277,429 to Smith, III, a game is disclosed in which randomly generated sounds must be matched to move the pieces.

The present invention differs from the known prior art by providing for a game board with movable playing pieces wherein the playing pieces are confined and non-removable from the game board as more further set forth in this specification.

SUMMARY OF THE INVENTION

This invention relates to a game board having movable, non-removable playing pieces. The game board has a series of different groups of confined predetermined track patterns or track stations in which each player moves his or her playing pieces in different directions. Adjacent stations are connected. Due to the configuration of the track, as it relates to the dimensions of the playing piece, each piece may be moved, but not removed, from their track station or the track system.

It is the primary object of the present invention to provide for an improved game board with non-removable playing pieces.

Another object is to provide for such an invention wherein each player is assigned a track pattern in which to move his/her playing piece within the track system.

These and other objects and advantages of the present invention will become apparent to readers from a consideration of the ensuing description and the accompanying drawings.

BRIEF DESCRIPTION OF THE DRAWINGS

FIGS. 5–6(*a*)–(*c*) show top and side views, respectively, of the base used with the preferred embodiment and two enlarged detailed cross sectional views, 6(*b*) and 6(*c*) of its sub components with side view 6(*c*) taken along line B—B of FIG. 5.

DESCRIPTION OF THE PREFERRED EMBODIMENT

Figure 2:
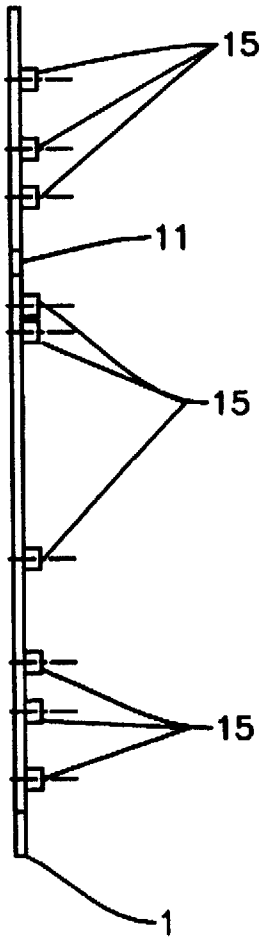
FIG. 2 is a side view of the FIG. 1 embodiment.
Figure 1:
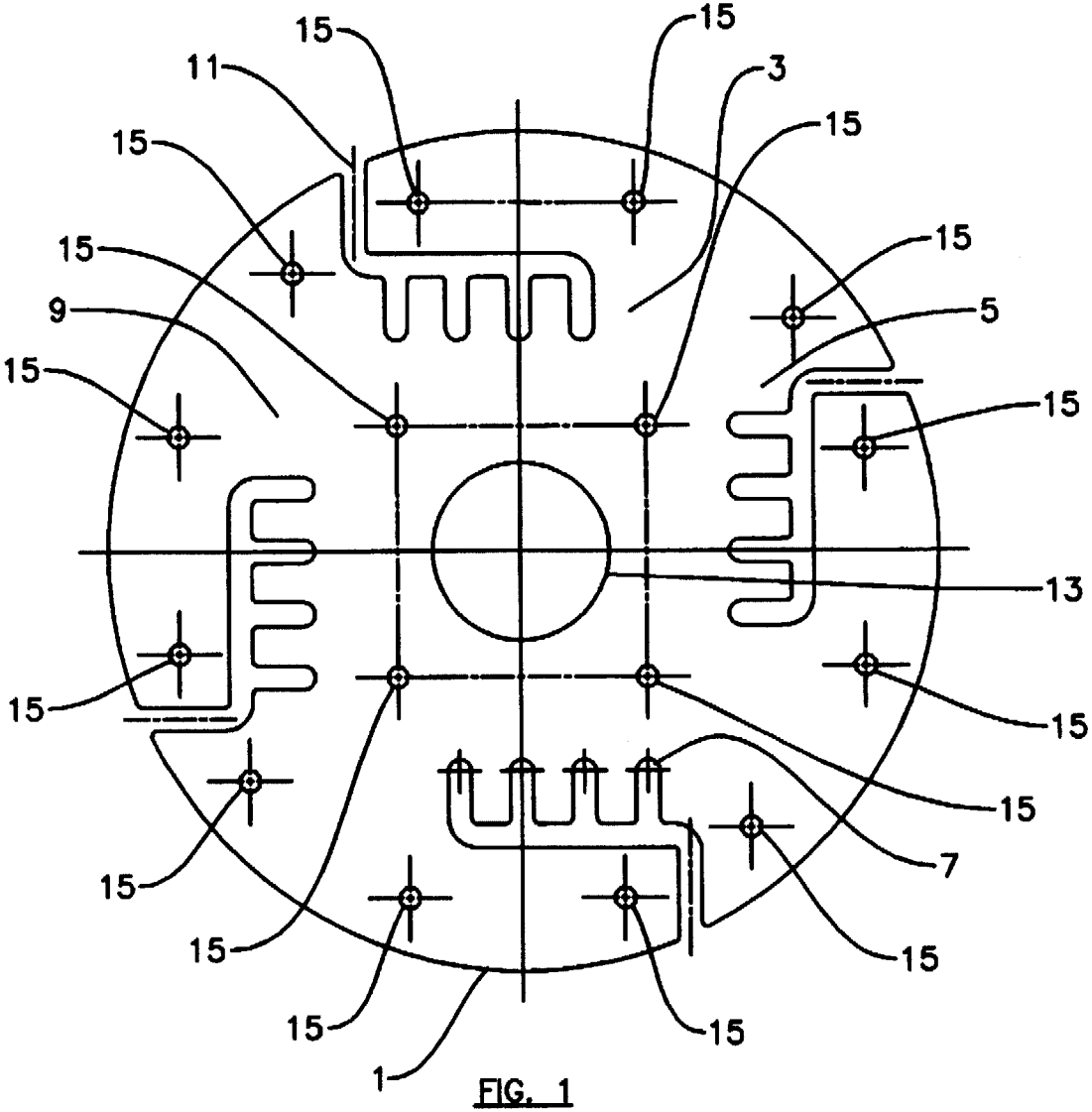
FIG. 1 is a top view of a center island of the game board's preferred embodiment.

The game board consists of several interrelated layered components consisting of a center island component, a game top component, and a base component. Two views of the circular, generally flat, planar center island component 1 are illustrated in FIGS. 1 and 2. In the top view, FIG.1, there are shown four identical cut outs indented from the surface playing track stations, or patterns, designated by the numbers 3,5,7 and 9 in which the playing pieces may be moved. Each of these track patterns take on a maze like configuration having an entrance 11 (e.g., see track pattern 3) to permit the playing pieces to enter or leave the pattern. At the center of the island component is an optional cut out circle 13 having a shape that will fit in the center island. Protruding from the center island's planar surface 1 are a series of spaced cylindrical depending protrusions 15, whose purpose is to permit the island section component to be joined to another lower base game board components described in FIG. 5 and FIGS. 6(*a*)–(*c*).

FIG. 2 is a side view of the FIG. 1 center island. Several of the depending protrusions 15 extending from one side of the island 1 are shown as well as the cut out entrance 11 for the track pattern or station 5.

Figure 3:
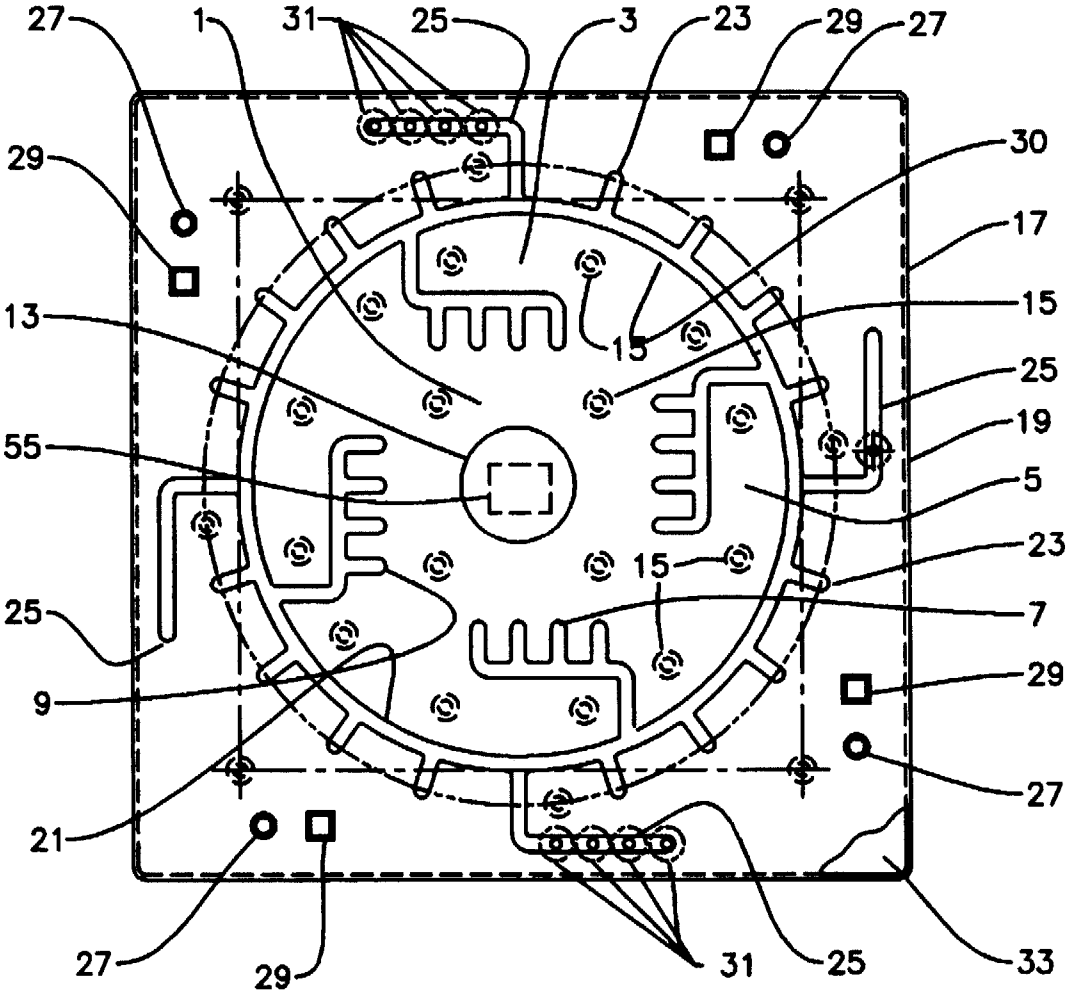
FIG. 3 shows a top view of the game top placed over the FIG. 1 center island.

FIG. 3 shows a top view of the game top 17 which can be placed over the FIG. 1 center island 1. This larger enclosing game top 17 has a square outer side perimeter 19 with rounded corners. Other shapes such as round could also be used for this top's perimeter. It also has its own cut out indented playing piece tracks that interconnect with the four track stations or patterns of the FIG. 1 center island. The top's innermost indented track 21, whose inner portion is defined by the outer periphery of the center island 1, is a large cut out circular track which joins each of the four track pattern entrances 11 to permit playing pieces to move between the track stations.

Jutting off the circular track 21 are several (sixteen shown) outwardly extending smaller shunt track segments 23 divided into groups associated with each track station. Each track station also has a longer right angled shunt cut out track 25 associated with it. Also, shown are the four indicator lights 27 and the optional switch 29, with one (optional) light and a switch for each track pattern. Depicted above the track station 3, in its associated right angled shunt track 25, are the tops of four playing pieces 31 which can be moved by hand within the confines of the track system consisting of the four track patterns, the connecting circular track 21, the several shunt tracks 23 and interconnected angled cut outs 25.

Figure 4:
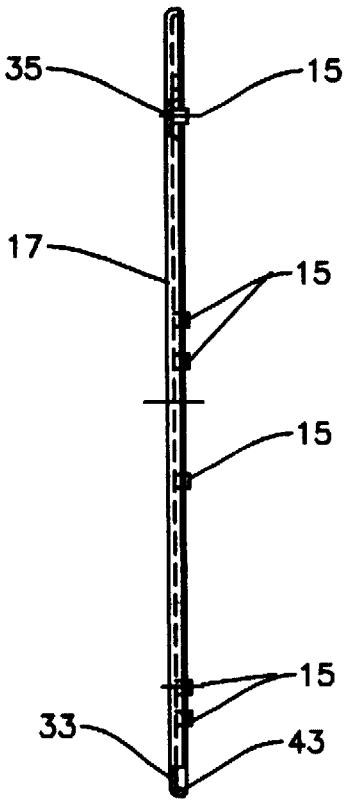
FIG. 4 is a side view of the FIG. 3 embodiment with the FIG. 2 center island included.

FIG. 4 is a side view of the FIG. 3 embodiment with the FIG. 2 center island 1 in-place under it. Part of the perimeter of top 17 has been cut away in the left corner side 33 (see also FIG. 3) and near one of the right protrusions 15 at area 35 to show the overlapping content of the larger top component 17 over the smaller center island game board component 1.

FIGS. 5–6 show top and side views, respectively, of the base used with the preferred embodiment and two enlarged detailed views of the base's sub components. Square (or other shaped) base 37 with its rounded corners corresponds in size and perimeter shape to the top 17 such that the top components fits over the base with the game board center island section 1 there between. Located on the flat planar base 37 are a series of circular female indentations 39 which are adapted and spaced to receive the male protrusions 15 depending from the center island 1. When in place the protrusions join these two component sections together.

Extending around the outer perimeter of base 37 is a cut out 41 (see FIG. 6(*b*)) which can engage a depending lower rim 43 located around the perimeter of the top section 17, as best shown in the cut out section 33 of FIG. 4. By pressing down on the top component 17, the base component 37 is joined to it by a tight "snap" fit thereon along its perimeter with the center island component section 1 layered in between to form the game board. This fit can also be achieved by gluing, heat sealing, or by using any type of conventional fastener.

The base's side view, in FIG. 6(*a*), as well as the enlarged edge detailed cut out upper right corner view, FIG. 6(*b*), and the enlarged cross sectional view along line B—B of FIG. 5, FIG. 6(*c*), all show the indented perimeter base cut out 41. Also shown in FIG. 6(*c*) is one of the circular base indentations wells 39 into which depending protrusions 15 fit. The upstanding circular sides 45 around indentation 39 insure that the in-place protrusion 15 of the center island will elevated the center island from the base's floor 47. This elevation defined by the length of the sides 45 provides the requisite track depth for the playing pieces to be moved in while in their tracks.

Figure 8:
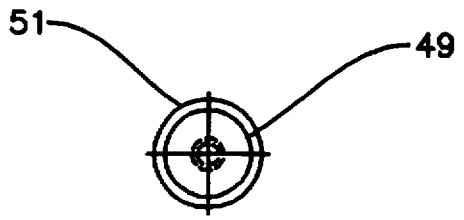
FIGS. 7–8 show side and bottom views, respectively, of one of the playing pieces used in the game board.
Figure 7:
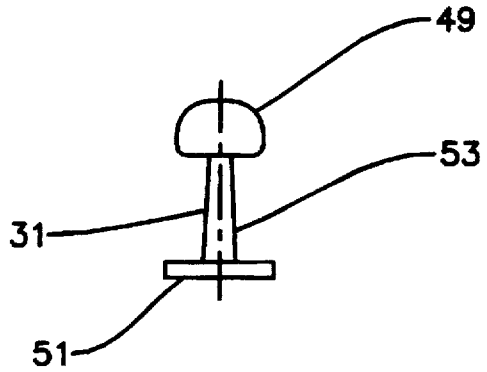

FIGS. 7–8 show side and bottom views, respectively, of one of the typical playing pieces 31 used in the game board. The enlarged top 49 is slightly smaller in outer diameter than the circular plate base 51 (see FIG. 7) The base 51 is larger than the width of the track 21. This top 49 may be dome shaped, as shown, or it may have a flat "penny" shape or any other desired shape. Indicia may be imprinted on the top. Joining the base to the top is an upwardly tapered section 53 having an appreciably smaller cross sectional area than either the top or the base. It is not necessary that the side 53 be tapered. It is in section 53 that the playing piece 31 rides as it is moved along the cut outs forming the indented tracks such as in the four track stations, the circular cut out 21, and its shunt tracks 23 and 25. By making the top 49 and its base 51 appreciably larger in diameter than the width of the track cut outs in the track system forming the tracks, the playing piece 31 is non-removable from the assembled game board's track system or their intersecting track segments (3, 5, 7, 9, and 25). For example, in one embodiment the tracks indentation is uniform in width and 0.281 inches wide. The section 53 has a maximum tapered outer diameter of 0.188 inches on its bottom, while the top 49 has a diameter of 0.50 inches and the circular base 51 is 0.625 inches in outer diameter.

In use each player is typically supplied with game pieces (for example, four) and must move them from the "base" position in its shunt 25 to their respective "home" position (3,5,7 or 9) by navigating around the board using track 21 and the shunt tracks (3,5,7 or 9). Each player must move all of their game pieces completely around the board (16 stops) before entering their home position. Typically movement of the game pieces is done by hand in board increments using dice, spinning a pointer, cards, etc., or after listening to a short segment of words or music (6 or 7 seconds long) that have been prerecorded on a cassette tape or compact disc (not shown).

An optional digital clock timer 55, shown by dotted lines in the center 13 of FIG. 3, starts counting backwards as soon as the audio segment is activated by the player whose turn it is. The sooner the player, who's turn it is, stops the timer, by using their electrically connected stop button 29, and correctly identifies the person, movie, song, etc. which corresponds to the audio words or music played, the further they will be able to advance a playing piece in its track. Thus , a correct answer at five would entitle the player to five moves.

Board markings or indicia 30 (see FIG. 3) on the top surface 17 may be used to indicate playing piece advancement segments, or units can be used to mark advancement board units for this purpose. In order to start the movement of a game piece the player must score a two or higher (corresponds to the time remaining on the timer). A player cannot jump their own piece. If one player lands on another player's space, the first player will return his or her game piece to the base starting position. While one player has his or her turn, a second player may push their switch 29 which blinks their light 27 to indicate they know the answer. This does not stop the play by the first player. It simply gives the second player, and only the second player, a chance to guess the played audio segment. The second player can play if ,and only if, the first player cannot correctly guess the audio segment.

The second intervening player will be identified by their blinking associated light 27. The most spaces the second player can advance a playing piece for a correct answer is one marked space on the board's surface. If the second player answers incorrectly, then he or she will move one game piece back two spaces or miss their turn if there are not any moved game pieces. The first player to get all of their game playing pieces to their "Home" position wins.

Also, it should be noted that the top surface of the playing pieces 31 are shown to be domed shaped, however, this is not the only shape that can be used. For example, the top could be flat and different indicia could be applied to the top to designate different players. Also, the indicia could be applied to the tops by self adhesives, or by magnetic means.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A combined game board and playing piece assembly comprising:

a game board having indented tracks in which playing pieces can be moved, said game board having a plurality of joined sections including a top and base section with substantially the same outside dimensions;

said tracks having a width and a plurality of identical adjacent track stations with each station having its own playing piece entrance and an adjoining track segment to an adjacent different track station;

said game board also having a center section between its top and base section, said center section having a series of depending protrusions, and said base section having indentations which engage the protrusions to join the two board sections together; and a movable playing piece adapted to ride in and be moved in said game board's indented tracks, said playing piece having an enlarged upper and lower base portion which is sufficiently larger in cross section than the width of the tracks whereby the playing piece cannot be removed from the tracks.

2. The assembly as claimed in claim 1, wherein said top section has a depending perimeter rim which engages an indentation in the perimeter of the base section to join the two sections together.

3. The assembly as claimed in claim 2, wherein there are a plurality of playing pieces associated with each track station, each playing piece having an enlarged upper and lower base portion which is larger in cross section than the width of the tracks, whereby the piece cannot be removed from the track.

* * * * *